US006843094B1

(12) United States Patent
Faitel et al.

(10) Patent No.: US 6,843,094 B1
(45) Date of Patent: Jan. 18, 2005

(54) BELTLINE HEMMING MACHINE

(76) Inventors: William M. Faitel, 53427 Meadowview La., New Baltimore, MI (US) 48047; David Paul Hubbard, Jr., 13311 Boca Grand Dr., Sterling Heights, MI (US) 48312; Douglas J. Schrandt, 52656 West Hills Dr., Chesterfield Township, MI (US) 48047

( * ) Notice: Subject to any disclaimer, the term of this patent is extended or adjusted under 35 U.S.C. 154(b) by 0 days.

(21) Appl. No.: 10/357,677

(22) Filed: Feb. 4, 2003

(51) Int. Cl.[7] ..... B21D 39/02
(52) U.S. Cl. ..... 72/315; 72/452.9; 29/243.58
(58) Field of Search ..... 72/312–315, 388, 72/306, 452.9; 29/243.58, 243.57

(56) References Cited

U.S. PATENT DOCUMENTS 6,295,858 B1 10/2001 Torito ..... 72/315

FOREIGN PATENT DOCUMENTS

| | | | |
|---|---|---|---|
| JP | 61-216818 | * | 9/1986 |
| JP | 61-216819 | * | 9/1986 |
| JP | 5-169163 | * | 7/1993 |
| JP | 2000-237830 | * | 9/2000 |

* cited by examiner

*Primary Examiner*—Daniel C. Crane

(57) ABSTRACT

A mechanism for hemming the beltline of a vehicle door panel is combined with a mechanism for hemming the outside perimeter of the door panel, and the two mechanisms are driven by a common drive. The beltline hemming steel acts on the beltline hem before the outside perimeter hemming steel acts on the outside perimeter hem, and lost motion in the actuation of the beltline hemming steel allows the beltline hemming steel to complete the beltline hem before the outside perimeter hem is completed. The lost motion mechanism provides reduced interaction or sensitivity between the steels, and the delay in the completion of the outside perimeter hem allows the entire hemming apparatus to be more easily tuned during set-up. The lost motion allows the entire mechanism to be less sensitive to variations in workpiece thickness.

21 Claims, 4 Drawing Sheets

BELTLINE HEMMING MACHINE

FIELD OF THE INVENTION

This invention relates to a drive arrangement for hemming steels that are driven by a common actuator for hemming the beltline and the outside perimeter of a vehicle door panel.

BACKGROUND OF THE INVENTION

In the field of automobile manufacture, hemming is the process of folding over the edge of a body panel to form a finished edge. Hemming is also used to join two body panels together, such as the inner and outer panels of a door. The hem provides a secure mechanical joint, and the resulting edge of the hemmed joint is neat and finished.

The lower edge of a window opening in a vehicle door panel is called the beltline. A reinforcing plate, normally called a beltline reinforcement, is usually attached to the inside of the outer panel along the beltline. The beltline reinforcement provides added strength to the door in the event of a side impact. Until the present time, the beltline reinforcement was attached to the outer panel by a series of spot welds. Although spot welds provide a secure mechanical connection between the beltline reinforcement and the outer panel, the welds show through on the Class A surface of the outer panel. As automobile fit and finish has become more refined, it has become increasingly important to mask over or otherwise obliterate any marks or indentations caused by the spot welding process so that they will not be visible on the outside panel surface. The normal solution is to cover welds of the beltline joint with a piece of trim material that is usually in the form of a chrome or rubber strip.

Hemming would be a desirable way to join the beltline reinforcement to the outer panel, since the hemming process inherently leaves the outer panel without impressions or marks that need to be masked over with trim material. A beltline hemming mechanism would be less expensive than weld guns, and if the beltline hemming could be performed at the same time as other hemming operations were being performed on the same panel, the overall processing time for the panel could be reduced. Until recently, hemming has not been used to join the beltline reinforcement to the outer panel, and there are various reasons for this. If hemming is being used to hem the inside perimeter of the window opening, the space in the window opening is already occupied by that hemming mechanism, and there is not enough room for a separate beltline hemming machine. If the beltline hemming mechanism is combined with the mechanism for hemming some other portion of the window opening or the door panel, the timing and synchronization of the motion of all of the hemming steels, if they are driven by a single actuator, becomes an almost impossible task, and it is very difficult to set-up the hemming steels so that they all reach a Final Hem Complete position at the same time. Even if the steels are perfectly timed relative to one another, any variation in the thickness of the workpiece in a production run, or in the stroke or timing of the steels, results in a final hem that is not completely closed, or a hemming mechanism that becomes overly stressed because it is being driven past the Final Hem Complete position. One solution is to provide a second hemming machine at its own station in order to do the beltline hemming. This eliminates the timing and synchronization issues between the beltline hemming steels and the other hemming steels and allows the beltline hemming machine to be set up and tuned independently of the other hemming machines. The second hemming machine requires additional floor space however, and, because a second dedicated drive is required, the second hemming machine represents a substantial additional cost.

It would accordingly be desirable to provide a hemming machine that would hem the beltline of a vehicle door panel in the same station that is performing other hemming on the panel, using a single machine and a single drive mechanism, but would allow the hemming tools to finish their respective hemming strokes at different times.

OBJECTS OF THE INVENTION

It is accordingly an object of the invention to provide hemming mechanism for hemming the beltline of a vehicle door panel in the same machine that hems the outside perimeter of the panel.

It is another object of the invention to provide a hemming mechanism for hemming the beltline and the outside perimeter of a vehicle door panel in which the beltline hem steel and the outside perimeter hem steel are driven by the same mechanism, but are able to have independent movements.

It is another object of the invention to provide a hemming mechanism for both the beltline and the outside perimeter of a vehicle door panel in which the beltline hem is finished prior to the time that the outside perimeter hem is finished.

SUMMARY OF THE INVENTION

According to the invention, a pressure plate is used to drive hem steels that pre-hem and hem the beltline of a vehicle door panel. The same pressure plate drives the steel that is used to final hem the outside perimeter of the panel. The beltline hemming steels and the outside perimeter hemming steels are actuated at different times, providing reduced interaction or sensitivity between the steels. The different actuation times allows the entire hemming apparatus to be more easily tuned during the set-up and run-off process, and to be less sensitive to variations in workpiece thickness.

BRIEF DESCRIPTION OF THE DRAWINGS

These and other objects, features and advantages of this invention will be apparent from the following detailed description, appended claims and accompanied drawings in which:

DETAILED DESCRIPTION OF THE PREFERRED EMBODIMENT

Figure 1:
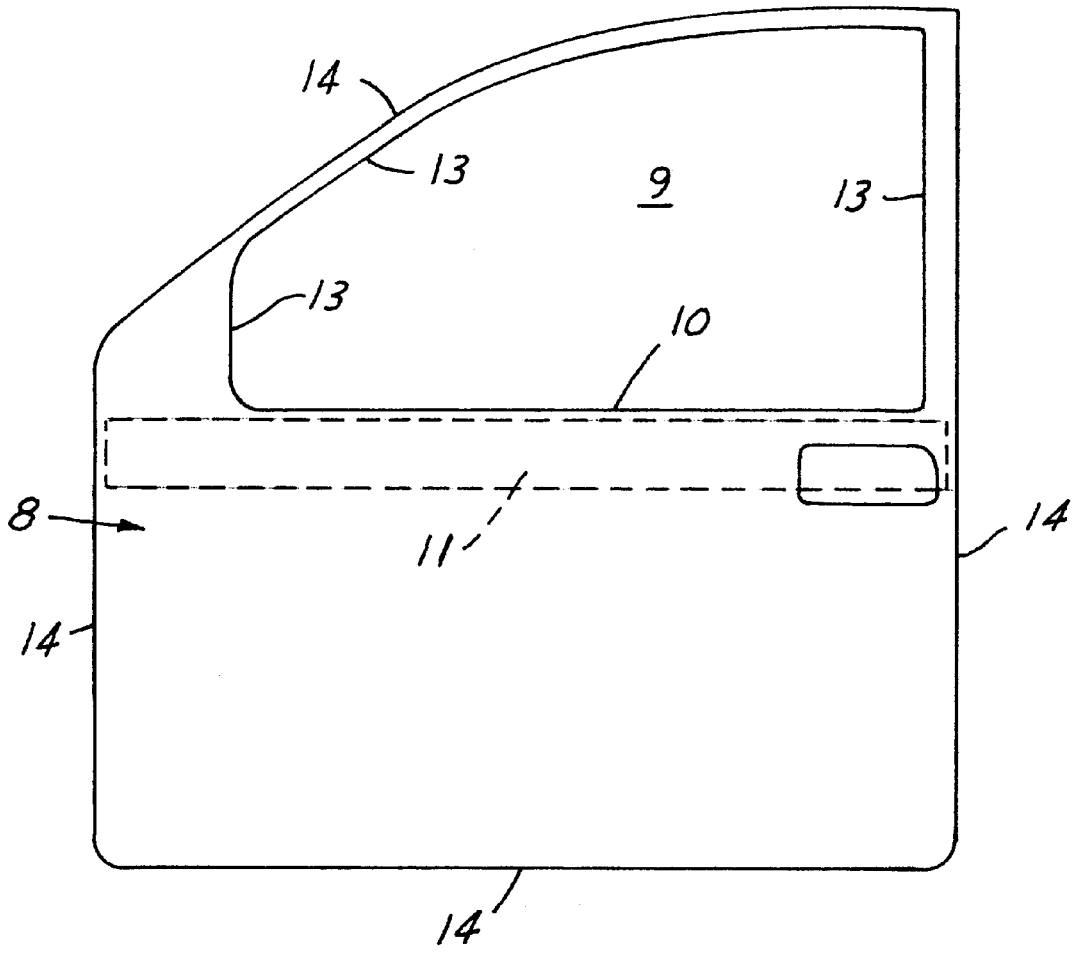
FIG. 1 is a plan view of a typical vehicle door panel having a window opening.

Turning now to the drawing figures, FIG. 1 shows the exterior of a typical vehicle door panel generally designated by the reference numeral 8. The door panel has a window opening 9 and a beltline 10 along its lower edge. A beltline reinforcement 11 is normally attached to the inside of the outer panel, just below the window opening 9. The inside and outside panels that comprise the complete door panel 8 may be joined together by an inside the window hem around the top and sides 13 of the window opening 9. To further join of the inner and outer panels together, the outside perimeter 14 of the inner and outer panels may be joined together by an outside perimeter hem.

Figure 2:
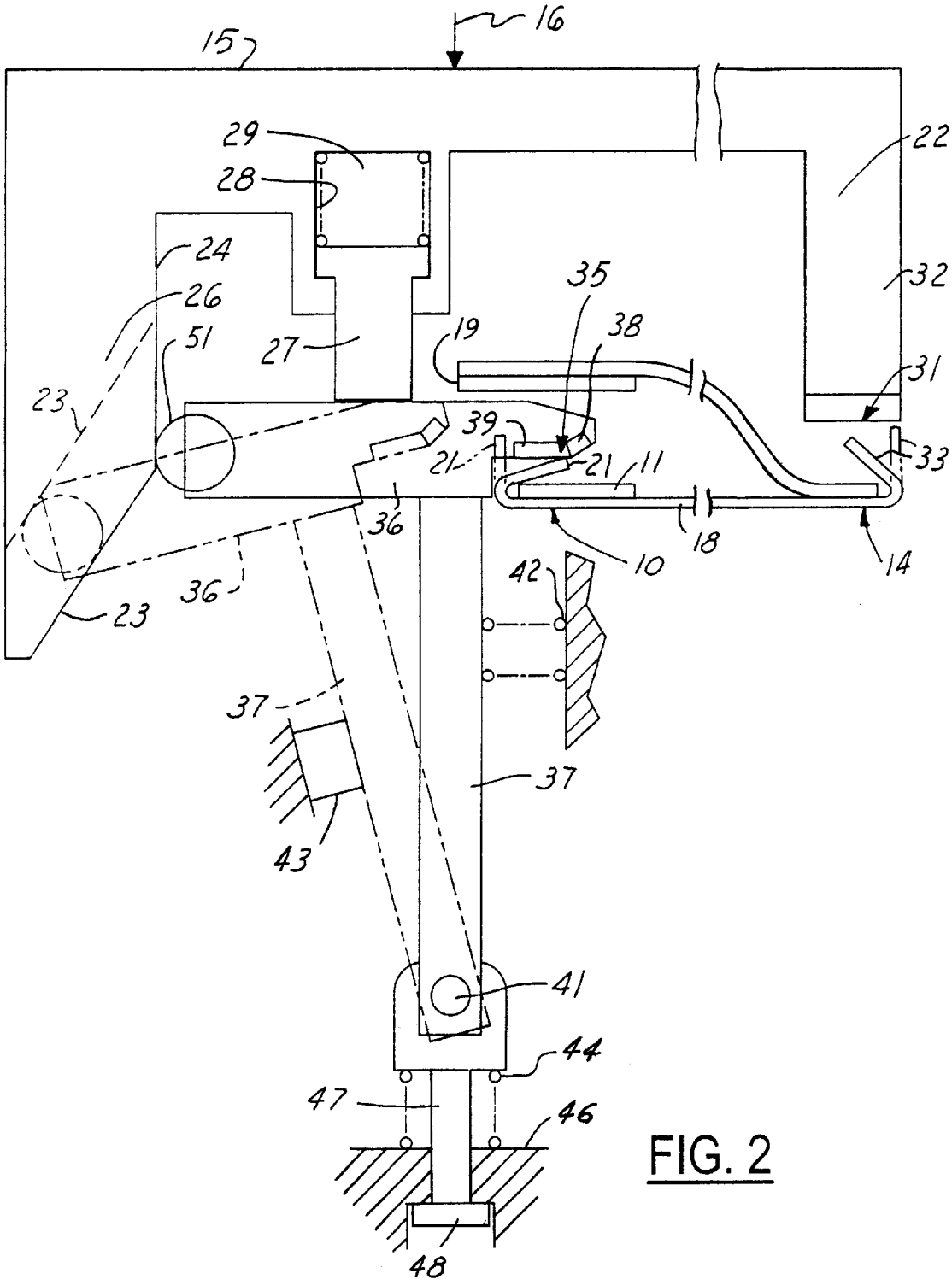
FIG. 2 is a cross sectional view of a hemming mechanism for hemming the beltline and the outside perimeter of a door panel showing the beltline hemming steel in both the Open and the Pre-Hem Complete positions.

FIG. 2 is a side view partly in section of a hemming mechanism that is used to hem the beltline 10 and the outside perimeter 14 of a vehicle door panel 8. The hemming mechanism includes a pressure plate 15 that is actuated by the force 16 from a press (not shown). The pressure plate 15 is located generally above a portion of a vehicle body panel 8 that has been loaded into the hemming apparatus. The vehicle body panel 8 includes an inner panel 17, an outer panel 18, and a beltline reinforcement 11. A flange 21 from the outer panel is folded over the beltline reinforcement 11 to form a beltline hem that attaches the beltline reinforcement 11 to the outer panel 18. A second reinforcement plate 19 similar to the beltline reinforcement 11 may be attached to the inner panel 17 by welding or other conventional means. The attachment of the second reinforcement plate 19 to the inner panel 17 does not form a part of the present invention. Spring loaded hold-down tooling (not shown) that is part of the hemming apparatus is conventionally used to engage the inner panel 17 to hold the workpiece securely in place. Such hold-down tooling is well known in the art and does not form a part of the present invention. The hold down tooling engages the workpiece prior to and during the pre-hemming and final hemming operation, but is not shown in the drawing figures for the sake of clarity.

An angled cam surface 23 that acts as a first actuator and a vertical cam surface 24 are formed on the side of a first extension foot 26 on the pressure plate 15. A pressure pad 27 that acts as a second actuator is slideably mounted in a pressure pad pocket 28 on the underside of the pressure plate 15. A spring 29 such as nitrogen gas spring is located in the pressure pad pocket 28 between the pressure pad 27 and the pressure plate 15. The stiffness of the spring is chosen so that it will drive the pressure pad 27 into the beltline hem flange 21 with sufficient force to fold the flange and complete the hem, but will allow the pressure pad 27 to be driven into the pressure pad pocket 28 in response to continued downward motion of the pressure plate 15. An outside perimeter hemming tool or steel 31 is mounted on the bottom of a second extension foot 32 on the pressure plate 15 in vertical alignment with the outside perimeter flange 33 on the outer panel 18.

A beltline hemming tool 35 is mounted on a fixture head 36 that is attached to a rocker arm 37. The hemming tool 35 comprises a pre-hem tool surface 38 and a final hem tool surface 39. The two surfaces 38 and 39 may be formed on a single piece of tool steel, or may be formed on two separate pieces of tool steel that are mounted adjacent to one another on the fixture head 36. The rocker arm 37 is pivotably mounted on a pivot 41, and a compression spring 42 is used to bias the rocker arm and fixture head to the left against a stop 43 as shown in the drawing figure. The pivot 41 for the rocker arm 37 is supported by a spring 44 so that the fixture head 36 and the rocker arm can be driven downward in order to close the beltline hem as described more fully below. The pivot 41 is mounted on a base 46 by means of a post 47 with an end stop 48 that is slideably received in the base 46. A roller 51 or other cam follower mechanism is mounted on one end of the fixture head 36, and the angular position of the rocker arm 37 and the fixture head 36 is determined by the portion of the cam surface 23 and 24 that is in contact with the cam follower 51.

FIG. 2 uses phantom and solid lines to show the rocker arm 37, the fixture head 36, and the hem flanges 21 and 33 in two positions. The rocker arm and fixture head shown in phantom are in the Open position in which the fixture head 36 is retracted from the beltline of the door panel 8 so that the door panel may be loaded or removed from the hemming machine. At the time the door panel 8 is first loaded, the beltline hem flange 21 is in the Open position as shown in phantom. A flange in the Open position allows the inner panel to be placed into the outer panel, and can normally be closed with two strokes of the hemming machine. The first stroke partially closes the Open flange to the Pre-Hem Complete position, and the second stroke completely closes the flange to the Final Hem Complete position. A flange in the Open position normally has to be rotated no more than 105 degrees to bend it to the fully closed or Final Hem Complete position.

FIG. 2 also shows in phantom the outside perimeter flange 33 formed on the edge of the outer panel 18 in the Open position. As a downward force 16 is applied by the press, the pressure plate 15 starts its vertical stroke. The angled cam surface 23 causes the rocker arm 37 and fixture head 36 to pivot to the right to the Pre-Hem Complete position in which the pre-hem steel 38 of the fixture head engages the beltline hem flange 21 and bends it from the Open position shown in phantom to the Pre-Hem Complete position as shown in solid. In the Pre-Hem Complete position, the pressure pad 27 is not yet in engagement with fixture head 36, and the outside perimeter hemming tool 31 has not yet engaged the outside perimeter hem flange 33. The outside perimeter hem flange 33 has been bent from the Open position shown in phantom to the Pre-Hem Complete position shown in solid by a separate pre-hem mechanism, not shown, as well known to those skilled in the art.

Figure 3:
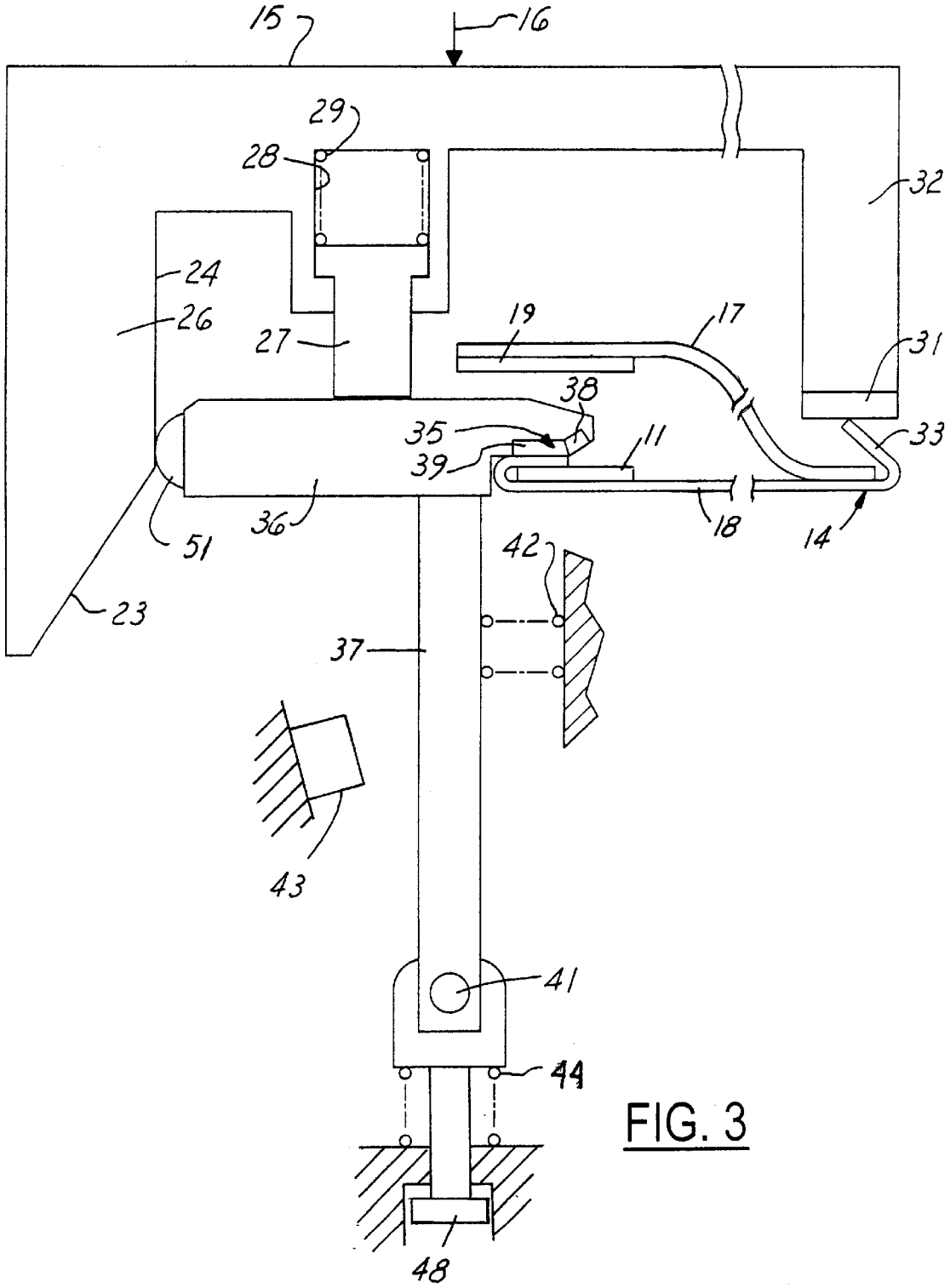
FIG. 3 is a cross sectional view of a hemming mechanism for hemming the beltline and the outside perimeter of a door panel showing the beltline hemming steel in the Final Hem Complete position and the outside perimeter hemming steel in the Pre-Hem Complete position.

FIG. 3 shows the beltline hemming mechanism after the beltline hem has been completed. The downward force 16 of the press on the pressure plate 15 acts through the spring 29 and the pressure pad 27 to depress the fixture head 36 and the final hem steel 39 so that the beltline hem flange 21 is bent by the final hem steel 39 to its Final Hem Complete position. With the pressure plate 15 in this vertical position, the outside perimeter hemming tool 31 has come into contact with the open flange 33 of the outside perimeter hem, but the outside perimeter hem has not yet been bent to the Final Hem Complete position.

Figure 4:
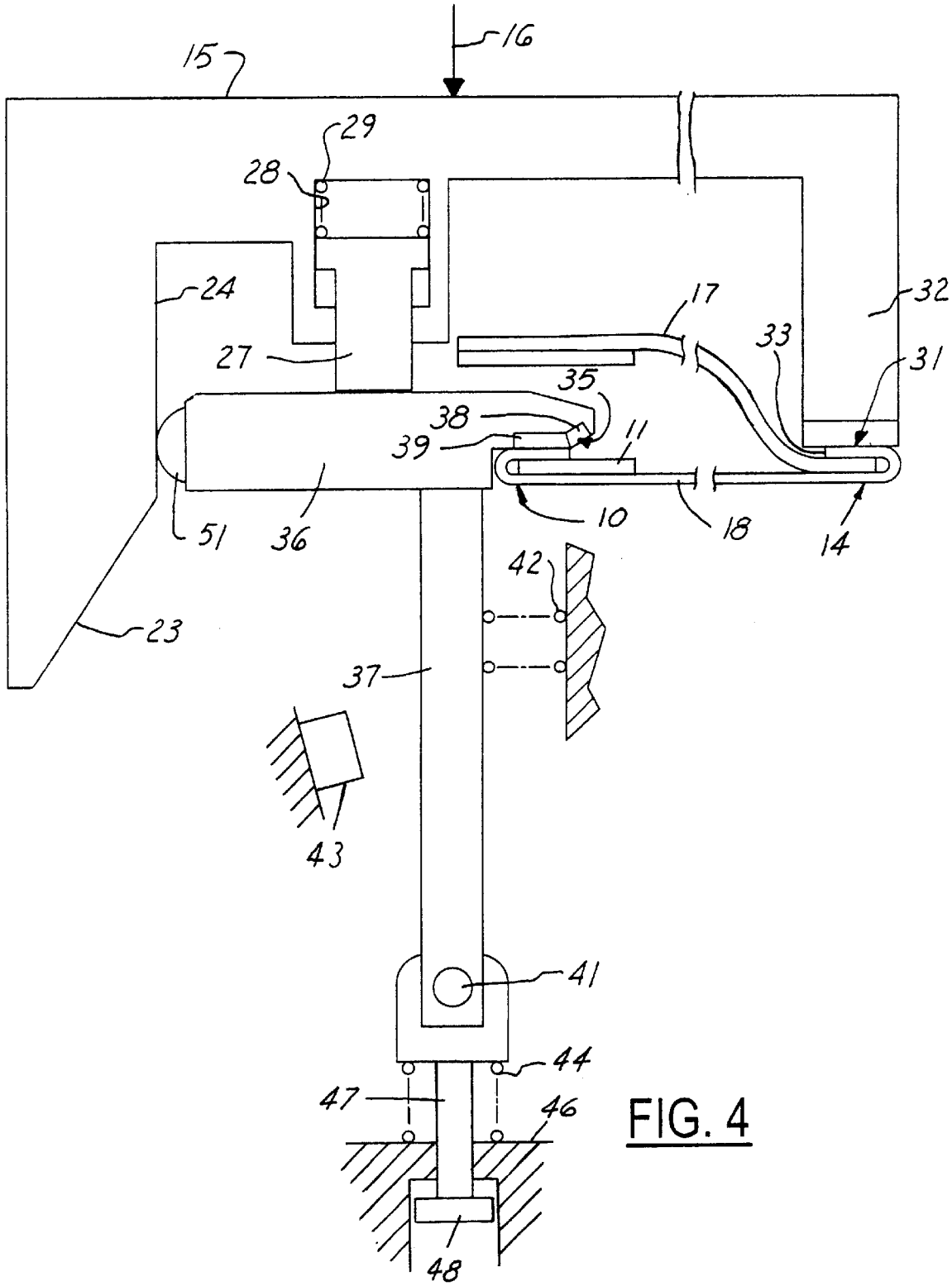
FIG. 4 is a cross sectional view of a hemming mechanism for hemming the beltline and the outside perimeter of a door panel showing the beltline hemming steel in the Final Hem position and the outside perimeter hemming steel in the Final Hem position.

FIG. 4 shows the beltline hemming mechanism after the outside perimeter flange 33 has been bent to its Final Hem Complete position. The downward force 16 of the press on the pressure plate 15 has acted through the second extension foot 32 to drive the outside perimeter hem steel 31 against the open flange 33 to bend it to the Final Hem Complete position. At the same time, since the beltline hem flange 21 was already bent to its closed position against the beltline reinforcement 11, the spring force of the spring 29 has been overcome to allow the pressure pad 27 to be driven into the pressure pad pocket 28, allowing the necessary downward travel of the pressure plate 15 and the outside perimeter hem steel 31 on the second extension foot 32 to close the outside perimeter flange 33.

Through the use of the invention, the beltline hem in a vehicle door panel can be bent to the Pre-Hem Complete and Final Hem Complete positions in one operation and using the same drive mechanism that is used to hem the outside perimeter hem to the Final Hem Complete position, by driving both hemming tools with a common pressure plate. In addition, variations in workpiece thickness or high spots on the workpiece are accommodated by coupling at least one of the hemming tools to the pressure plate through a spring. The spring between the pressure plate and the pressure pad provides a lost motion and allows the pressure plate to continue its downward stroke to bend the outside perimeter hem to the Final Hem Complete position, although the beltline hem flange is already bent to the Final Hem Complete position. This also allows the beltline hemming steels to be set-up independently of the outside perimeter hemming steels, thus simplifying the set-up process, and the making the mechanism less sensitive to variations in the workpiece thickness, since the position of one of the hemming steels in the Final Hem Complete position is not dependent on the position of the other hemming steel. For this reason, the invention is also applicable to any hemming operation where it is desired to hem two distinct areas of a workpiece, such as the inside and outside of a window opening, using two hemming mechanisms that are driven by a single press.

Having thus described the invention, various alterations and modifications will occur to those skilled in the art, which modifications and alterations will be deemed to be within the scope of the invention as defined by the appended claims.

We claim:

1. A hemming machine for hemming the beltline hem and the outside perimeter hem of a vehicle door panel, the hemming machine comprising:

a pressure plate that is actuated by a force from a press, a beltline hemming tool and an outside perimeter hemming tool, both of which are driven by the pressure plate, a first actuator that is driven by the pressure plate and is arranged to drive the beltline hemming tool into the beltline hem flange and to bend the beltline hem flange from an Open position to a Pre-Hem Complete position, a second actuator that is driven by the pressure plate to drive the beltline hemming tool into the beltline hem flange and to bend the beltline hem flange from a Pre-Hem Complete position to a Final-Hem Complete position, and a third actuator that is driven by the pressure plate to cause the outside perimeter hemming tool to bend the outside perimeter flange from a Pre-Hem Complete position to a Final-Hem Complete position, whereby the third actuator positions the outside perimeter hemming tool relative to the outside perimeter flange such that the outside perimeter hemming tool does not bend the outside perimeter hem to the Final Hem Complete position until after the beltline hem flange is bent to the Final Hem Complete position.

2. The hemming machine of claim 1 further comprising:

an angled cam surface coupled to the pressure plate, whereby the angled cam surface comprises the first actuator.

3. The hemming machine of claim 1 further comprising:

a pressure pad coupled to the pressure plate; and a compliant member interposed between the pressure plate and the pressure pad, whereby the pressure pad comprises the second actuator and the pressure plate drives the pressure pad through the compliant member.

4. The hemming machine of claim 3 wherein the compliant member comprises a spring member.

5. The hemming machine of claim 4 wherein the spring member comprises a nitrogen gas spring.

6. The hemming machine of claim 1 wherein the beltline hemming tool is mounted on a fixture head and the fixture head is mounted on a rocker arm that is mounted on a pivot.

7. The hemming machine of claim 6 wherein the fixture head and the beltline hemming tool are driven by the first actuator in an arcuate motion to bend the beltline hem from an Open position to a Pre-Hem Complete position.

8. The hemming machine of claim 7 wherein the fixture head and the beltline hemming tool are driven by the second actuator in a straight line motion to bend the beltline hem from a Pre-Hem Complete position to a Final-Hem Complete position.

9. The hemming machine of claim 8 wherein the outside perimeter hemming tool is not driven into the outside perimeter hem until after the beltline hem tool has bent the beltline hem to the Final-Hem Complete position.

10. The hemming machine of claim 3 wherein the compliant member compresses and the pressure pad is driven in a pressure pad pocket as the outside perimeter hemming tool bends the outside perimeter hem to the Final Hem Complete position.

11. The hemming machine of claim 3 wherein the complaint member compresses and the pressure pad is driven into a pressure pad pocket before the outside perimeter hemming tool bends the outside perimeter hem to the Final Hem Complete position.

12. A process for hemming the beltline hem and the outside perimeter hem of a vehicle door panel, the process comprising:

actuating a pressure plate by a force from a press, positioning a beltline hemming tool and an outside perimeter hemming tool to be driven by the pressure plate, driving first and second actuators by means of the pressure plate and driving the beltline hemming tool by means of the first and second actuators, bending the beltline hem flange from an Open position to a Pre-Hem Complete position by translating the force applied to the pressure plate to cause the first actuator to drive the beltline hemming tool into the beltline hem flange, bending the beltline hem flange from a Pre-Hem Complete position to a Final-Hem Complete position by translating the force applied to the pressure plate to cause the second actuator to drive the beltline hemming tool into the beltline hem flange, and driving the outside perimeter hemming tool by means of the pressure plate and delaying the bending of the outside perimeter hem to the Final Hem Complete position until after the beltline hem has been bent to the Final Hem Complete position.

13. The process of hemming a beltline hem according to claim 12 further comprising the steps of:

positioning a compliant member between the pressure plate and the second actuator, and coupling the movement of the pressure plate to the beltline hemming tool through the compliant member.

14. The process of hemming a beltline hem according to the process of claim 12 further comprising the steps of:

mounting the beltline hemming tool on a rocker arm, mounting the rocker arm on a pivot, driving the beltline hemming tool by the first actuator in an arcuate motion to bend the beltline hem from an Open position to a Pre-Hem Complete position.

15. The process of hemming a beltline hem according to claim 14 further comprising the steps of:

additionally mounting the beltline hemming tool on a Support that is able to be driven in a straight line motion, and driving the beltline hemming tool in a straight line motion to bend the beltline hem from a Pre-Hem Complete position to a Final-Hem Complete position.

16. A hemming machine for hemming a first hem and a second hem on a vehicle door panel, the hemming machine comprising:

a pressure plate that is actuated by a force from a press, a first hemming tool and a second hemming tool, both of which are driven by the pressure plate, a first actuator that is driven by the pressure plate and is arranged to drive the first hemming tool into a first hem flange and to bend the first hem flange from an Open position to a Pre-Hem Complete position, a second actuator that is driven by the pressure plate to drive the first hemming tool into the first hem flange and to bend the first hem flange from a Pre-Hem Complete position to a Final-Hem Complete position, and a third actuator that is driven by the pressure plate to cause the second hemming tool to bend the second hem flange from a Pre-Hem Complete position to a Final-Hem Complete position, whereby the third actuator positions the second hemming tool relative to the second hem flange such that the second hemming tool does not bend the second hem flange to the Final Hem Complete position until after the first hemming tool has bent the first hem to the Final-Hem Complete position.

17. The hemming machine of claim 16 further comprising:

a pressure pad coupled to the pressure plate and a compliant member interposed between the pressure plate and the pressure pad, whereby the pressure pad comprises the second actuator and the pressure plate acts on the pressure pad through the compliant member.

18. The hemming machine of claim 17 wherein the compliant member comprises a spring member.

19. The hemming machine of claim 18 wherein the spring member comprises a nitrogen gas spring.

20. The hemming machine of claim 17 wherein the compliant member is compressed as the second hemming tool bends the second hem to the Final Hem Completer position.

21. The hemming machine of claim 20 wherein the complaint member is compressed before the second hemming tool bends the second hem to the Final Hem Complete position.

* * * * *

UNITED STATES PATENT AND TRADEMARK OFFICE

CERTIFICATE OF CORRECTION

PATENT NO. : 6,843,094 B1
DATED : January 18, 2005
INVENTOR(S) : Faitel et al.

It is certified that error appears in the above-identified patent and that said Letters Patent is hereby corrected as shown below:

Column 2,
Lines 13-14, after "provide" insert therein -- a --.
Line 36, after "times" delete "allows" and insert therein -- allow --.

Column 3,
Line 8, after "join" delete "of".

Column 5,
Line 14, after "process, and" delete "the".

Column 8,
Line 20, after "Final Hem" delete "completer" and insert therein -- Complete --.
Line 23, after "wherein the" delete "complaint" and insert therein -- compliant --.

Signed and Sealed this

Twenty-sixth Day of July, 2005

JON W. DUDAS
*Director of the United States Patent and Trademark Office*